US005551748A

United States Patent [19]

McKelvey et al.

[11] Patent Number: 5,551,748

[45] Date of Patent: Sep. 3, 1996

[54] PORTABLE SHOOTING BENCH

[76] Inventors: Patrick McKelvey, P.O. Box 483; Dick Baird, P.O. Box 802, both of Hines, Oreg. 97738

[21] Appl. No.: 402,858

[22] Filed: Mar. 13, 1995

[51] Int. Cl.[6] ..... A47B 39/00

[52] U.S. Cl. ..... 297/170; 297/283.1; 297/440.13

[58] Field of Search ..... 297/440.13, 440.1, 297/440.14, 283.1, 3, 1, 118, 135, 156, 160, 161, 170–172, 174, 195.11; 42/94

[56] References Cited

U.S. PATENT DOCUMENTS

| | | | |
|---|---|---|---|
| 2,215,657 | 9/1940 | Anderson | 297/156 X |
| 2,456,111 | 12/1948 | Creech | 297/440.13 X |
| 4,296,963 | 10/1981 | Blanchard et al. | 297/170 |
| 4,433,753 | 2/1984 | Watson | 297/440.13 X |
| 4,506,466 | 3/1985 | Hall | 42/94 |
| 4,740,032 | 4/1988 | Olsen et al. | 297/440.13 X |
| 4,834,450 | 5/1989 | Stickler | 297/440.13 X |
| 5,011,228 | 4/1991 | Marcantel | 297/440.13 |

FOREIGN PATENT DOCUMENTS

| | | | |
|---|---|---|---|
| 2417277 | 9/1979 | France | 297/440.13 |
| 203654 | 10/1908 | Germany | 297/171 |

*Primary Examiner*—Milton Nelson, Jr.

[57] ABSTRACT

A shooting bench for supporting a shooter and an associated firearm relative to a ground surface. The device includes a main support member supported in a substantially upright position by a forward leg member and a rearward seat support member. A top member extends across the forward leg member and a seat member extends across the rearward seat support member. The top member is positioned above and forward of the seat member such that a shooter residing on the seat member may rest a rifle along or above the top member during aiming and discharging of the firearm. Preferably, the members are substantially planar and include slots permitting sliding interconnection of the members without a use of additional fasteners.

6 Claims, 3 Drawing Sheets

PORTABLE SHOOTING BENCH

BACKGROUND OF THE INVENTION

1. Field of the Invention

The present invention relates to collapsible furniture structures and more particularly pertains to a portable shooting bench for supporting a shooter and an associated firearm relative to a ground surface.

2. Description of the Prior Art

The use of collapsible furniture structures is known in the prior art. More specifically, collapsible furniture structures heretofore devised and utilized for the purpose of supporting individuals relative to a ground surface are known to consist basically of familiar, expected and obvious structural configurations, notwithstanding the myriad of designs encompassed by the crowded prior art which have been developed for the fulfillment of countless objectives and requirements.

For example, a chair with interlocking multiple components is illustrated in U.S. Pat. No. 4,712,837 which is easily assembled and disassembled for transport, storage, and use. The chair components include right and left hand leg members, a seat member, a back member, an arm member having right and left hand arm portions joined by an interconnecting section, and a support member. Each of the components is planar and is either configured as an equilateral triangle or as a base on an equilateral triangle. The components are formed with slots to interlockably connect one component to another.

Another patent of interest is U.S. Pat. No. 4,740,032 which teaches a compact and lightweight bench with removable parts permitting rapid, compact and lightweight assembling and disassembling thereof.

Other known prior art collapsible furniture structures are disclosed in U.S. Pat. Nos. 4,188,067; 4,919,480; 4,032,188; and 3,572,824.

While these devices fulfill their respective, particular objectives and requirements, the aforementioned patents do not disclose a portable shooting bench for supporting a shooter and an associated firearm relative to a ground surface which includes a main support member supported in a substantially upright position by a forward leg member and a rearward seat support member, with a top member extending across the forward leg member and a seat member extending across the rearward seat support member such that the top member is positioned above and forward of the seat member to allow a shooter residing on the seat member to rest a rifle along or above the top member during aiming and discharging of the firearm. Furthermore, none of the known prior art collapsible furniture structures teach or suggest a portable shooting bench of the aforementioned structure in which the members thereof are substantially planar and include slots permitting sliding interconnection of the members without a use of additional fasteners.

In these respects, the portable shooting bench according to the present invention substantially departs from the conventional concepts and designs of the prior art, and in so doing provides an apparatus primarily developed for the purpose of supporting a shooter and an associated firearm relative to a ground surface.

SUMMARY OF THE INVENTION

In view of the foregoing disadvantages inherent in the known types of collapsible furniture structures now present in the prior art, the present invention provides a new portable shooting bench construction wherein the same can be utilized for supporting a shooter and an associated firearm relative to a ground surface. As such, the general purpose of the present invention, which will be described subsequently in greater detail, is to provide a new portable shooting bench apparatus and method which has many of the advantages of the collapsible furniture structures mentioned heretofore and many novel features that result in a portable shooting bench which is not anticipated, rendered obvious, suggested, or even implied by any of the prior art collapsible furniture structures, either alone or in any combination thereof.

To attain this, the present invention generally comprises a shooting bench for supporting a shooter and an associated firearm relative to a ground surface. The inventive device includes a main support member supported in a substantially upright position by a forward leg member and a rearward seat support member. A top member extends across the forward leg member and a seat member extends across the rearward seat support member. The top member is positioned above and forward of the seat member such that a shooter residing on the seat member may rest a rifle along or above the top member during aiming and discharging of the firearm. Preferably, the members are substantially planar and include slots permitting sliding interconnection of the members without a use of additional fasteners.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable shooting bench apparatus and method which has many of the advantages of the collapsible furniture structures mentioned heretofore and many novel features that result in a portable shooting bench which is not anticipated, rendered obvious, suggested, or even implied by any of the prior art collapsible furniture structures, either alone or in any combination thereof.

It is another object of the present invention to provide a new portable shooting bench which may be easily and efficiently manufactured and marketed.

It is a further object of the present invention to provide a new portable shooting bench which is of a durable and reliable construction.

An even further object of the present invention is to provide a new portable shooting bench which is susceptible of a low cost of manufacture with regard to both materials and labor, and which accordingly is then susceptible of low prices of sale to the consuming public, thereby making such portable shooting benches economically available to the buying public.

Still yet another object of the present invention is to provide a new portable shooting bench which provides in the apparatuses and methods of the prior art some of the advantages thereof, while simultaneously overcoming some of the disadvantages normally associated therewith.

Still another object of the present invention is to provide a new portable shooting bench for supporting a shooter and an associated firearm relative to a ground surface.

Yet another object of the present invention is to provide a new portable shooting bench which includes a main support member supported in a substantially upright position by a forward leg member and a rearward seat support member, with a top member extending across the forward leg member and a seat member extending across the rearward seat support member such that the top member is positioned above and forward of the seat member to allow a shooter residing on the seat member to rest a rifle along the top member during aiming and discharging of the firearm.

Even still another object of the present invention is to provide a new portable shooting bench of the aforementioned structure in which the members are substantially planar and include slots permitting sliding interconnection of the members without a use of additional fasteners.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
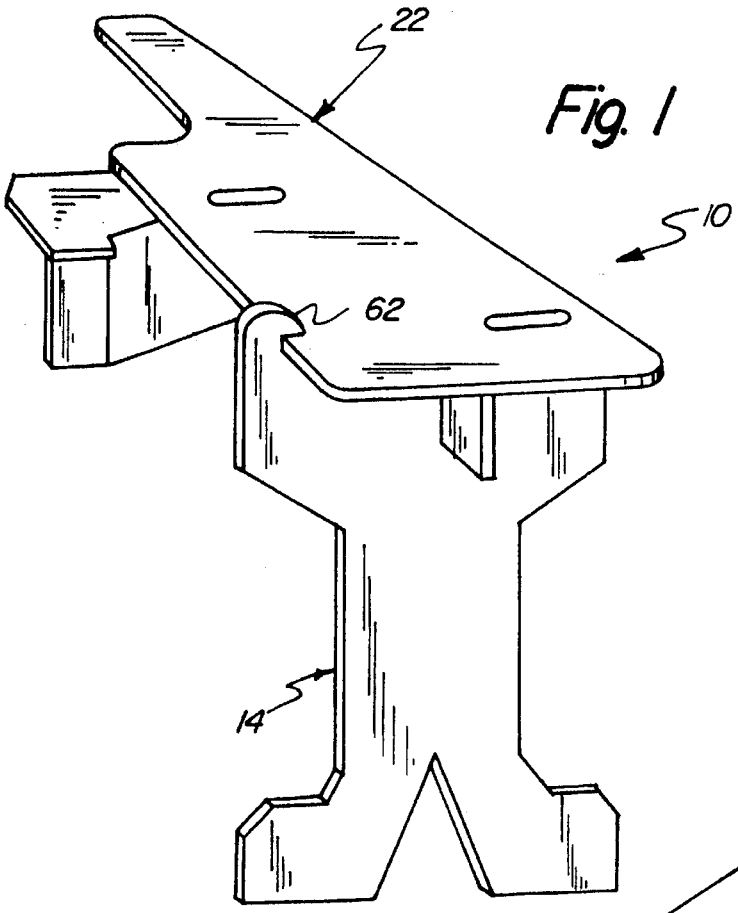
FIG. 1 is an isometric illustration of a portable shooting bench according to the present invention configured for left-handed use.

With reference now to the drawings, and in particular to FIGS. 1–5 thereof, a new portable shooting bench embodying the principles and concepts of the present invention and generally designated by the reference numeral 10 will be described.

Figure 2:
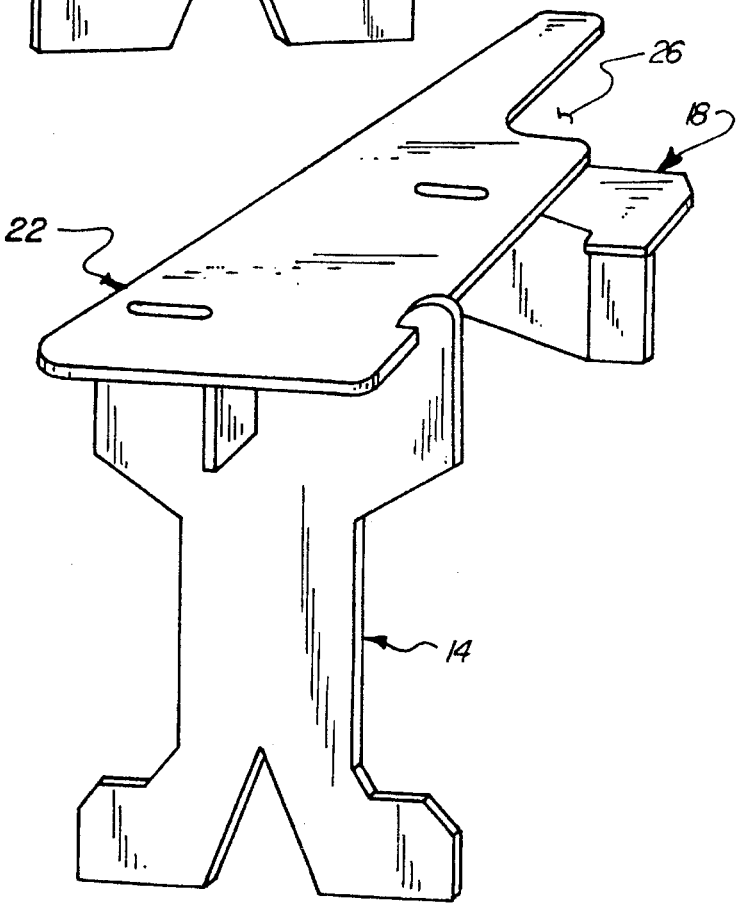
FIG. 2 is an isometric illustration of the portable shooting bench configured for right-handed use.
Figure 3:
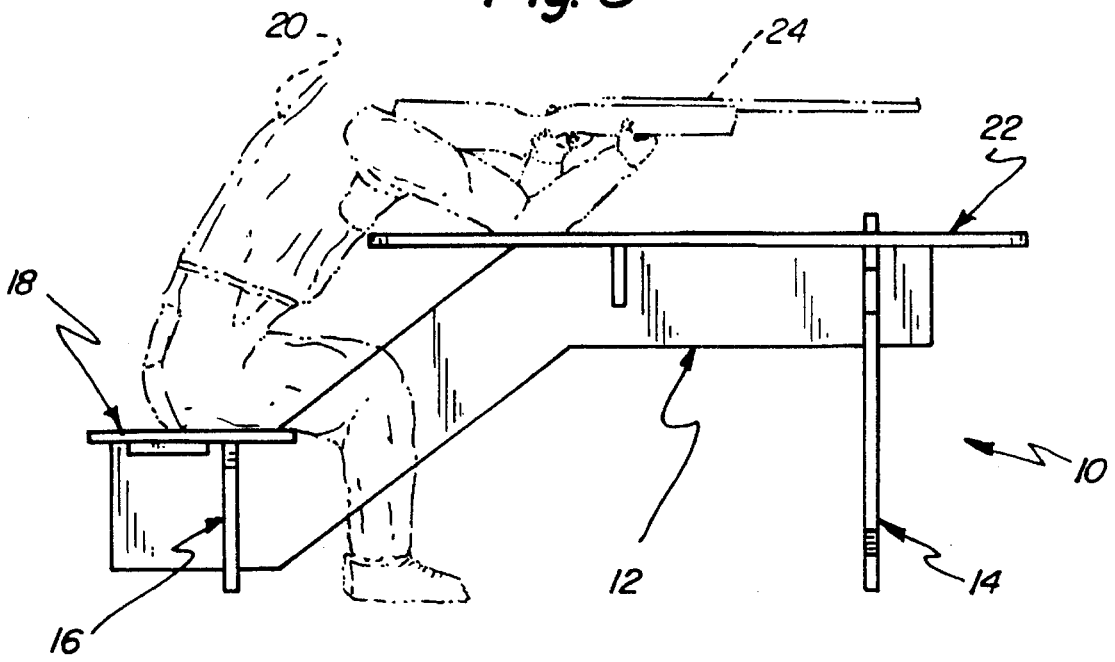
FIG. 3 is a side elevation view of the present invention in use.
Figure 4:
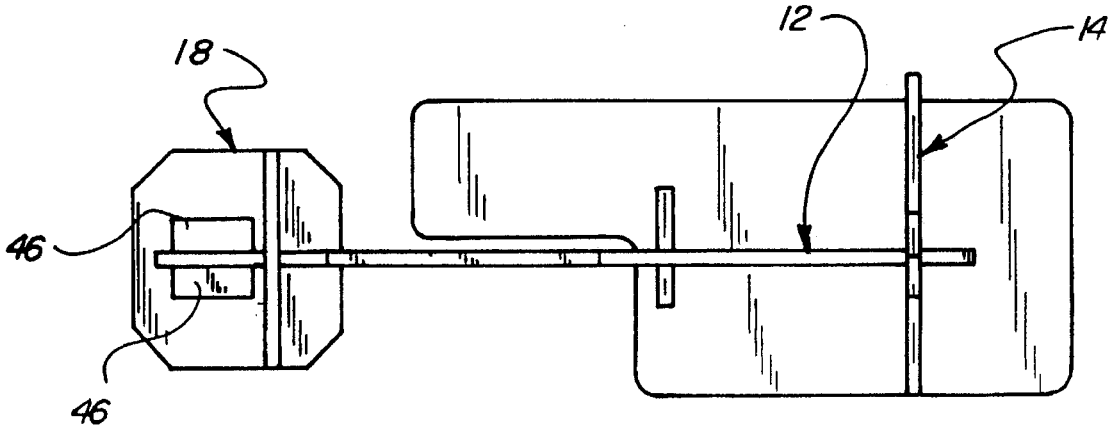
FIG. 4 is a bottom plan view thereof.

More specifically, it will be noted that the portable shooting bench 10 comprises a main support member 12, a forward leg member 14 and a seat support member 16 which cooperate and interconnect with the main support member 12 to support the same in a substantially vertical orientation as illustrated in FIG. 3. A seat member 18 extends across the seat support member 16 and provides an area upon which a shooter 20 may sit or reside. A top member 22 extends across the forward leg member 14 and along a portion of the main support 12 to provide an area upon which the shooter 20 may rest during the aiming and shooting of a rifle 24 or other firearm. As illustrated in FIGS. 1 and 2, the top member 22 is shaped so as to define a cutout 26 which permits projection of the trigger arm of the shooter 20 below the plane of the top member. To accommodate both left and right handed shooters 20, the device 10 may be configured into a left-handed orientation as illustrated in FIG. 1, or into a right-handed orientation as illustrated in FIG. 2 in a manner which will hereinafter be described in more detail.

Figure 5:
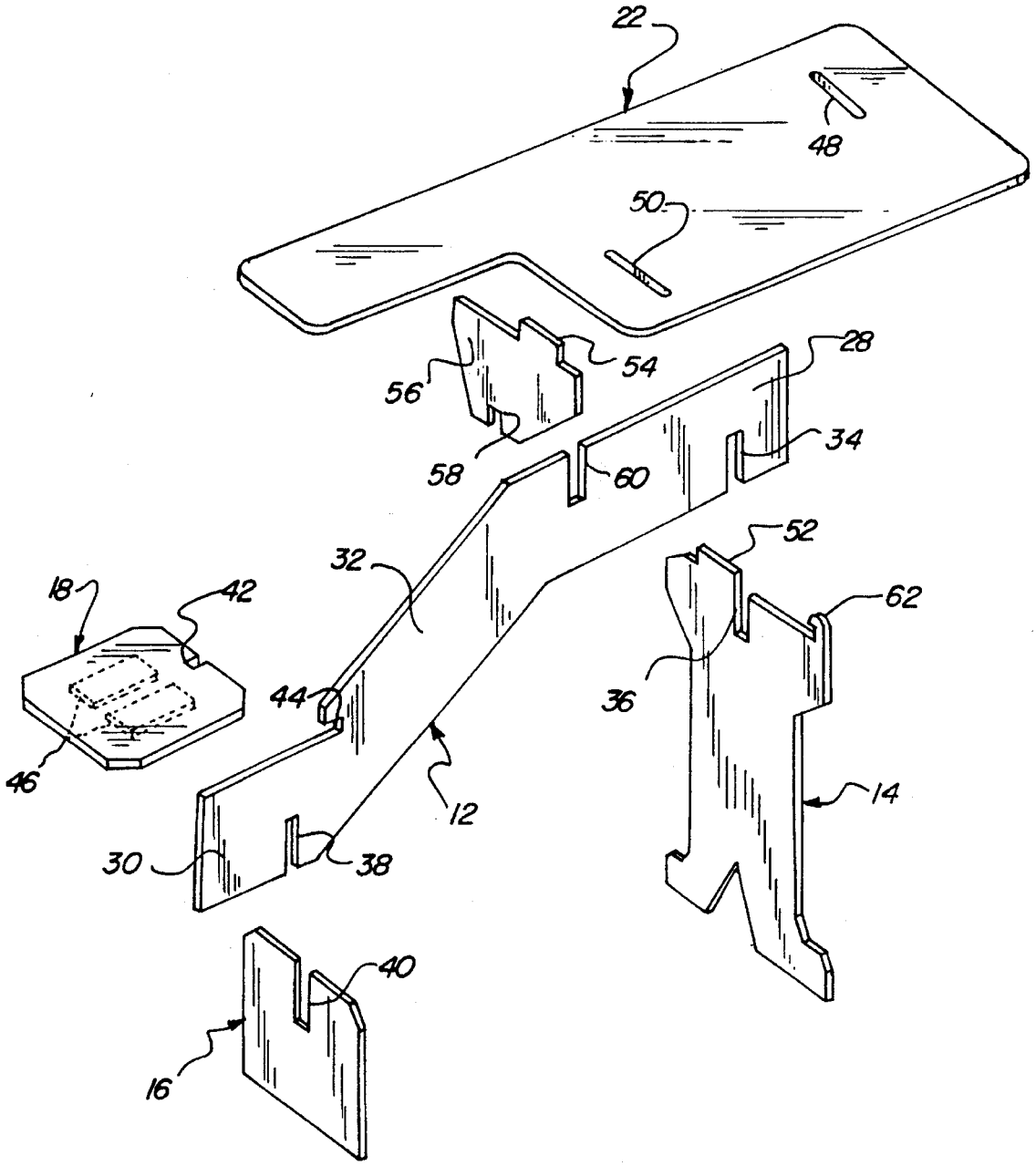
FIG. 5 is an exploded isometric illustration of the invention.

Referring now to FIG. 5, it can be shown that the main support member 12 is substantially planar and includes an upper portion 28 connected to a lower portion 30 by an angled medial portion 32 such that the upper portion is spaced from and parallel to the lower portion. The upper portion 28 of the main support member 12 includes a downwardly oriented first upper portion slot 34 which cooperates with an upwardly extending forward leg slot 36 of the forward leg member 14 to releasably couple the forward leg member to the main support member. By this structure, the slots 34, 36 may slidably interconnect so as to align overlapping portions of the forward leg member 14 and the upper portion 28 of the main support member 12 in a substantially orthogonal relationship.

To releasably interconnect the seat support member 16 to the lower portion 30 of the main support member 12, a downwardly projecting lower portion slot 38 formed in the lower portion may be engaged to an upwardly projecting seat support slot 40 of the seat support member so as to join the seat support member to the lower portion of the main support member in a substantially orthogonal orientation.

The seat member 18 is positioned atop the lower portion 30 of the main support member 12 and extends substantially orthogonally to both the lower portion and the seat support member 16. To releasably couple the seat member 18 to the main support member 12, the seat member is provided with a forwardly extending seat slot 42 which may be releasably engaged to a rearwardly extending medial portion slot 44 formed in the medial portion 32 at an upper juncture of the medial portion and the lower portion 30. Further, a pair of spaced guide blocks 46 are secured to a bottom surface of the seat member 18 so as to straddle the lower portion 30 and rest upon an uppermost edge of the seat support member 16. The spaced guide blocks 46 impart both lateral and rotational stability to the seat member 18 while simultaneously transferring a weight of the shooter 20 to the seat support member 16.

The top member 22 orthogonally extends across both the forward leg member 14 and the upper portion 28 of the main support member 12. To secure the top member 22 in such orthogonal orientation relative to the forward leg member 14 and the main support member 12, a pair of transverse slots 48, 50 extend through the top member. The slots 48, 50 include a first transverse slot 48 offset towards a first edge of the top member 22, and a second transverse slot 50 offset towards a second edge of the top member. The first transverse slot 48 is operable to receive a forward leg projection 52 extending upwardly from the forward leg member 14, and the second transverse slot 50 is operable to receive a transverse support projection 54 extending upwardly from a transverse support member 56. The transverse support member 56 includes a downwardly extending transverse support slot 58 which may be releasably engaged to an upwardly extending second upper portion slot 60 formed in the upper portion 28 of the main support member 12 so as to removably couple the transverse support member 56 to the main support member 12. The transverse support member 56 imparts both lateral and rotational stability to the top member 22. To further such lateral and rotational stability of the top member 22, a catch 62 extends upwardly from the forward leg member 14 so as to engage a portion of an upwardly facing surface of the top member 22.

To assemble the device 10 in the left-handed orientation of FIG. 1, the members 14–22 and 56 may simply be assembled in the manner illustrated in FIG. 5. To configure the device 10 into the right-handed orientation illustrated in FIG. 2, the forward leg member 14 and the transverse support member 56 may simply be rotated one-half turn about a vertical central axis and engaged to the respective slots 34, 60 of the upper portion 28, while the top member is simply rotated one-half turn about a longitudinal horizontal axis, thereby aligning the transverse slots 48, 50 with the associated projections 52, 54. Thus, the portable shooting bench 10 may be easily reconfigured for either a left or right-handed shooter 20.

In use, the planar components of the portable shooting bench 10 may be stacked flat for reduced transportation and storage space requirements, and easily assembled into a desired orientation without requiring a use of tools.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new portable shooting bench comprising:

a main support member including an upper portion connected to a lower portion by a medial portion such that the upper portion is spaced from and parallel to the lower portion, said lower portion having a downwardly projecting lower portion slot formed therein, said medial portion having a horizontally extending medial portion slot formed in said medial portion at an upper juncture of said medial portion and said lower portion, said upper portion including a downwardly oriented first upper portion slot;

a forward leg member having an upwardly extending forward leg slot releasably engaged to said first upper portion slot, said leg member further having a leg projection extending upwardly therefrom;

a seat support member having an upwardly extending seat support slot releasably engaged to said lower portion slot;

a seat member extending across the seat support member, said seat member having a seat slot releasably engaged to said medial portion slot;

and, a top member extending across an upper edge of said forward leg member and along said upper portion of said main support member, said top member having a first transverse slot extending therethrough with said leg projection extending at least partially into said first transverse slot of said top member.

2. The portable shooting bench as recited in claim 1, wherein said upper portion further includes an upwardly oriented second upper portion slot, and further comprising a transverse support member having a downwardly extending transverse support slot releasably coupled to said second upper portion slot, said transverse support member having a transverse support projection extending upwardly and extending at least partially into said transverse slot in the top member.

3. The portable shooting bench as recited in claim 2, wherein said leg member further includes an upwardly extending catch engaged to said top member.

4. The portable shooting bench as recited in claim 3, wherein said top member is shaped so as to define a cutout which permits projection of an arm of a shooter below a plane of said top member.

5. The portable shooting bench as recited in claim 4, wherein said bench is adapted to be assembled in both a left-handed orientation and a right-handed orientation.

6. The portable shooting bench as recited in claim 5, wherein said top member, said forward leg member, and said transverse support member are separable, said forward leg member and said transverse support member are rotatable one-half turn about vertical central axes thereof, and said top member is rotatable about a longitudinal horizontal axis, whereby said top member, said forward leg member, and said transverse support member are assemblable to change a configuration of the bench from a left-handed orientation to a right-handed orientation.

* * * * *